US008141753B2

(12) United States Patent
Ostermeier et al.

(10) Patent No.: US 8,141,753 B2
(45) Date of Patent: Mar. 27, 2012

(54) EJECTION DEVICE

(75) Inventors: Peter Ostermeier, Diessen (DE); Franz Heiberger, Stettfurt (CH); Ingo Loeschky, Kaufering (DE); Rainer Strobel-Schmidt, Bad Woerishofen (DE); Christian Hefele, Breitenbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 674 days.

(21) Appl. No.: 12/288,320

(22) Filed: Oct. 16, 2008

(65) Prior Publication Data

US 2009/0101678 A1 Apr. 23, 2009

(30) Foreign Application Priority Data

Oct. 19, 2007 (DE) ..... 10 2007 000 544

(51) Int. Cl.
*B65D 88/54* (2006.01)

(52) U.S. Cl. ..... 222/326; 222/137; 222/144; 222/145.6; 222/391

(58) Field of Classification Search ..... 222/135–137, 222/325–327, 391, 144, 145.1, 145.5, 145.6, 222/386

See application file for complete search history.

(56) References Cited

U.S. PATENT DOCUMENTS

| | | | | |
|---|---|---|---|---|
| 2,605,763 | A * | 8/1952 | Smoot | 604/70 |
| 3,568,892 | A * | 3/1971 | Burk | 222/327 |
| 5,104,005 | A | 4/1992 | Schneider et al. | |
| 5,224,628 | A | 7/1993 | Keller | |
| 6,454,136 | B1 * | 9/2002 | Evans | 222/174 |
| 2002/0145015 | A1 | 10/2002 | Nelson | |
| 2002/0190082 | A1 | 12/2002 | Keller | |
| 2006/0283891 | A1 | 12/2006 | Kovac | |

FOREIGN PATENT DOCUMENTS

| | | | |
|---|---|---|---|
| DE | 94 14 069 | U1 | 10/1994 |
| WO | WO-2006/015596 | | 2/2006 |

* cited by examiner

*Primary Examiner* — J Casimer Jacyna
(74) *Attorney, Agent, or Firm* — Abelman, Frayne & Schwab

(57) ABSTRACT

An ejection device (11) for cartridges containing multi-component compounds has an ejection mechanism (12) and a receptacle (16) for the cartridge, with the receptacle (16) being limited on the front side by a head plate (17) and on the rear side by a stop plate (18) and in order to hold the cartridge in a first position, a first stop (21) provided at the head plate (17) and a second stop (22) provided in the area of the stop plate (18), and a third stop (23) in order to hold the cartridge in a further position.

6 Claims, 2 Drawing Sheets

EJECTION DEVICE

BACKGROUND OF THE INVENTION

1. Field of the Invention

The invention relates to an ejection device for cartridges containing compounds having an ejection mechanism and a receptacle for the cartridge and which is limited on the front side by a head plate and on the rear side by a stop plate, and has, in order to hold the cartridge in a first position, a first stop provided at the head plate and a second stop provided in the area of the stop plate.

2. Description of the Prior Art

An ejection device of the type mentioned above is used for dispensing multi-component compounds, such as mortar compounds or sealing compounds which are packaged in cartridges, at the cite of application. The ejection device usually has a forward feed mechanism whose actuation causes a forward feed means such as, for example, a piston rod, to be displaced by a predetermined extent. Pressure transmission means arranged at the piston rod acts on the compound located in the cartridge so that a corresponding amount of the compound is dispensed through a dispensing opening with every forward stroke.

An ejection device of the generic type for cartridges containing compounds is known from U.S. Pat. No. 5,104,005. The head plate has a slot for receiving a mixer connection of the cartridge. This slot forms the first stop for holding the cartridge. In the area of the stop plate, a U-shaped member is provided which connects the two side walls and whose connection portion forms the second stop for holding the cartridge.

It is disadvantageous in the known solution that a cartridge inserted in the receptacle is held in the receptacle in only one position or orientation. In order to apply different compounds with different mixing ratios with an ejection device of this type, different cartridges with a corresponding design must be inserted. However, the variation of possible mixing ratios is very limited due to the design of the receptacle.

SUMMARY OF THE INVENTION

It is the object of the invention to provide an ejection device for cartridges containing compounds and with which compounds having different mixing ratios can be dispensed in a simple manner.

This and other objects of the present invention, which will become apparent hereinafter, are achieved by providing at least one additional stop for holding the cartridge in a position in the receptacle other than the first position.

The multi-component compound contained in the cartridge is dispensed by the ejection device corresponding to the cartridge that is inserted. When the cartridge has a ratio of components of A:B, the cartridge in the inserted state, for example, contacts the first stop of the receptacle with a mixer connection or mixer housing and contacts the second stop of the receptacle with a wall portion at a distance from the mixer connection and is held in the receptacle by the latter in the corresponding position or orientation. If, on the other hand, the cartridge has a ratio of components of A:C, the cartridge in the inserted state contacts the first stop, for example, with the mixer connection or mixer housing and at least one additional stop with the wall portion at a distance from the mixer connection and is held in the receptacle by the latter in the other position or orientation. The cartridge is designed in such a way that it can be fixed in the receptacle only when correctly positioned in accordance with the compound to be dispensed.

Cartridges with three or more receptacle chambers for different components of a multi-component compound can also be inserted in the receptacle so as to be correctly positioned. For example, a cartridge with three receptacle chambers has an A component in one receptacle chamber and a B component, respectively, in the two other receptacle chambers, and the two other receptacle chambers differ in their volume. A multi-component compound whose mixing ratio is adaptable as needed or based on the ambient conditions is available to the user when required. Different head parts are used depending upon the combination of receptacle chambers. If the user wants to dispense a compound with a determined mixing ratio but has the wrong head part arranged at the cartridge, the mixer connection, for example, does not come into contact with the first stop at the head plate because the cartridge contacts the second, or the at least one additional, stop when inserted into the receptacle. The user immediately notices that the cartridge is not inserted in the desired manner, which substantially eliminates incorrect applications.

The at least one additional stop preferably has a spring element which, depending on the design of the cartridge, acts upon a wall portion of the cartridge that is inserted into the receptacle and holds this cartridge in the position for dispensing the compound with the ejection mechanism. The spring element advantageously has a portion whose free end projects into the receptacle, this portion forming a contact surface for a part of the wall portion that surrounds one of the receptacle chambers of the cartridge. When a cartridge is inserted into the receptacle which comes into contact with the first stop and the second stop of the receptacle in the correctly inserted state, at last one portion of the spring element can yield when this cartridge is inserted, and allows a correct insertion. The at least one additional stop is advantageously arranged in such a way, or the cartridge is designed in such a way, that the cartridge can be brought into contact only with the first stop and with the other stops in the receptacle. This prevents any incorrect application on the part of the user.

The receptacle is preferably limited laterally by side walls extending between the head plate and the stop plate, and the at least one additional stop is provided at one of the side walls of the receptacle, which makes possible a simple design of the cartridge corresponding to the type of compound to be applied.

The at least one additional stop is preferably displaceable along the side wall so that the ejection device can be adapted in a simple manner to cartridges of different lengths.

The at least one additional stop is preferably arranged at the receptacle so as to be removable so that the ejection device can easily be adapted to differently designed cartridges. When the at least one additional stop is designed as a spring element, it is advantageously clipped on at a portion defining the receptacle.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

Identical parts are provided with the same reference numbers in the drawings in principle.

DETAILED DESCRIPTION OF THE PREFERRED EMBODIMENT

Figure 1:
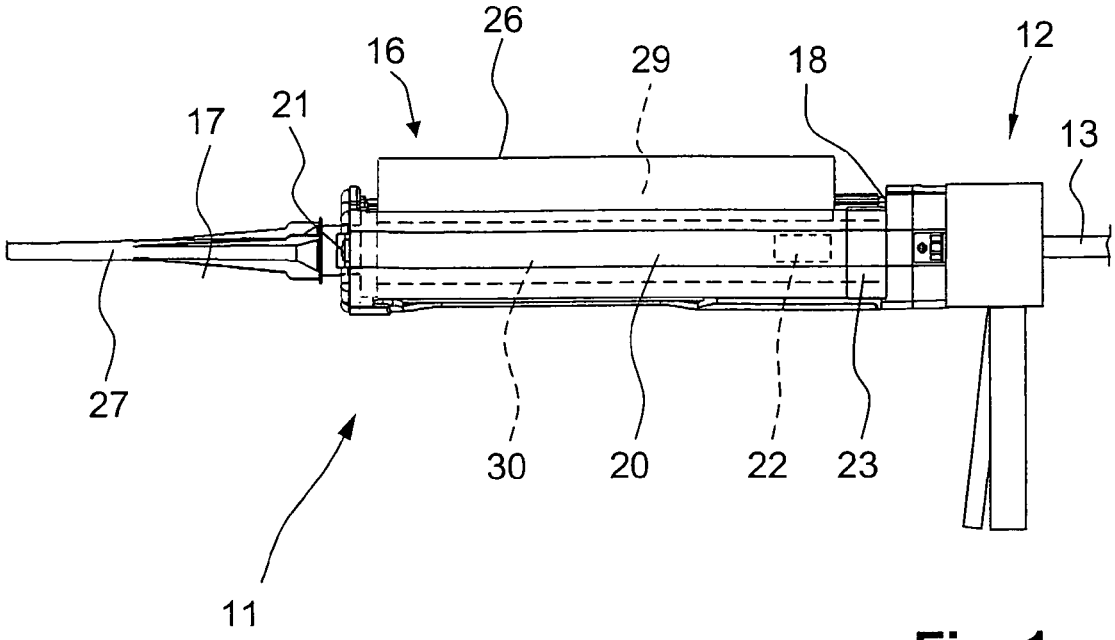
FIG. 1 a side view of an ejection device according to the present invention with an inserted cartridge.
Figure 2:
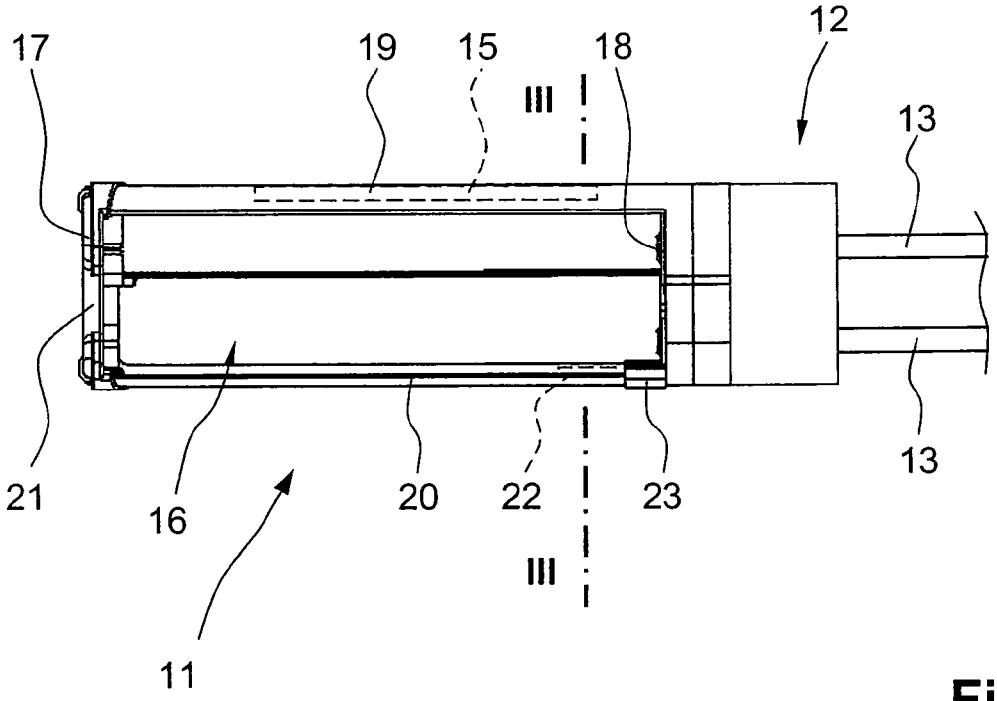
FIG. 2 a plan view of the receptacle of the ejection device shown in FIG. 1 without the inserted cartridge.
Figure 3:
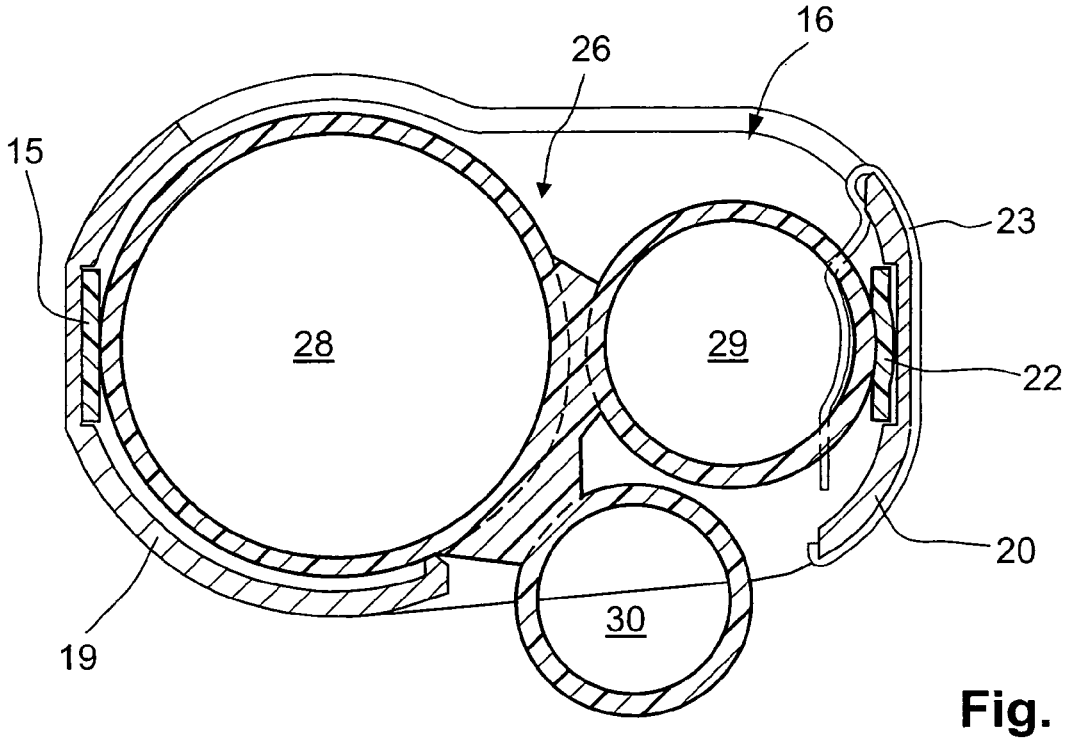
FIG. 3 a cross-sectional view along line III-III in FIG. 2 with inserted cartridge in a first position.
Figure 4:
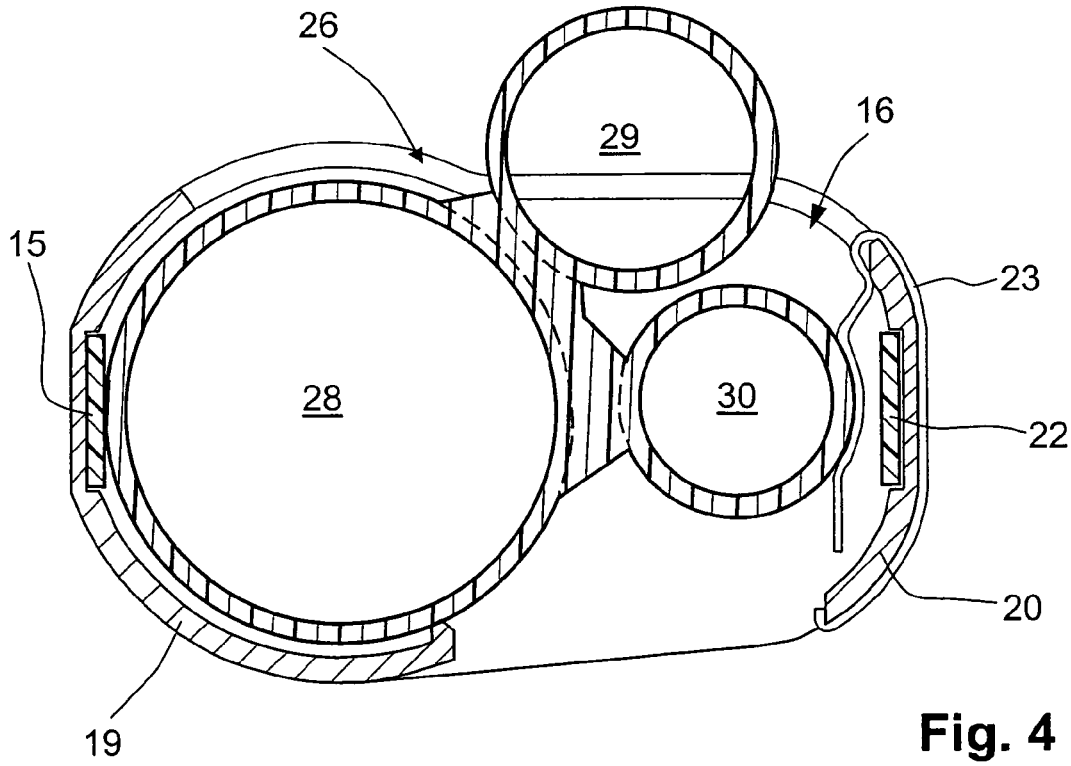
FIG. 4 a cross-sectional view similar to that of FIG. 3 with the inserted cartridge in a second position.

The ejection device 11 for cartridges 26 containing compounds and which is shown in FIGS. 1 to 4, has an ejection mechanism 12 with two piston rods 13 and a receptacle 16 for a cartridge 26. The cartridge 26 has a first receptacle chamber 28, a second receptacle chamber 29, and a third receptacle chamber 30. A component A of the multi-component compound to be squeezed-out is provided in the first receptacle chamber 28. A component B of the multi-component compound to be squeezed-out is provided in the other receptacle chambers 29 and 30, respectively. The two receptacle chambers 29 and 30 differs in their receptacle volume. In the position of the cartridge 26 shown in FIG. 3, the compound is dispensed, e.g., in a ratio of component A to component B of 3:1. In the position of the cartridge 26 shown in FIG. 4, the compound is dispensed, e.g., in a ratio of component A to component B of 5:1.

The receptacle 16 of the ejection device 11 is limited on the front side by a head plate 17 and on the rear side by a stop plate 18, and laterally by side walls 19 and 20 extending between the head plate 17 and the stop plate 18. A receptacle for a mixer housing 27 of the cartridge 26 is provided at the head plate 17 as a first stop 21 to hold the cartridge 26. A second stop 22 is provided in the area of the stop plate 18 at the side wall 20 for holding the cartridge 26. The first stop 21 and the second stop 22 hold the cartridge 26 in the receptacle 16 in a first position or orientation.

Another, third stop 23 for the cartridge 26 is provided in a portion of the side wall 20 between the second stop 22 and the stop plate 18. The first stop 21 and the other, third stop 23 hold the cartridge 26 in the receptacle 16 in a second position or orientation. A holding element 15 is provided on the inner side at the side wall 19 as means for securing the cartridge 26 in the inserted position.

The additional, third stop 23 is a spring element which encloses the side edges of the side wall 20 and is arranged in position in a clamping manner at the side wall 20. The additional, third stop 23 is provided at the receptacle 16 so as to be removable and is displaceable along the side wall 20. The free portion 24 of the third stop 23 comes into contact with a part of the wall portion of the cartridge 26 surrounding the receptacle chamber 30 when the cartridge 26 is inserted in the receptacle 16 in a corresponding manner. As is shown in FIG. 1, the receptacle chamber 29 has a shorter longitudinal extension than the receptacle chamber 30. This and the arrangement of the additional, third stop 23 between the second stop 22 and the stop plate 18 ensure that no part of the wall portion surrounding the receptacle chamber 29 comes into contact with the additional, third stop 23 when the cartridge 26 is inserted in the first position.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An ejection device for two-component compound-containing cartridges having two receiving chambers with a size of at least one receiving chamber varying dependent on a predetermined ratio of components in the compound, the ejection device comprising an ejection mechanism (12); and a receptacle (16) for receiving the cartridge (26) and having a head plate (17) for limiting the receptacle (16) on a front, in an ejection direction, side thereof, a stop plate (18) for limiting the receptacle (16) on a rear side thereof opposite the front side, first (21) and second (22) stops provided, respectively, at the head plate (17) and the stop plate (18) for holding a cartridge (26) in the receptacle in a first position, and at least one additional stop (23) for holding the cartridge (26) in the receptacle in a second position between the first stop (21) and the at least one additional stop (23) when the size of the at least one receiving chamber changes, wherein the ejection device comprises side walls (19, 20) extending between the head plate (17) and the stop plate (18) for limiting the receptacle (16) laterally, and the at least one additional stop (23) is provided at one of the side walls (20), and wherein the at least one additional stop (23) is displaceable along the one of the side walls (20).

2. An ejection device according to claim 1, wherein the at least one additional stop (23) comprises a spring element.

3. An ejection device according to claim 1, wherein the at least one additional stop (23) is removably arranged at the receptacle (16).

4. An ejection device for two-component compound-containing cartridges having three receiving chambers, with one chamber containing a first component and two other chambers containing a second component, at least the two other chambers having different sizes to provide for different ratios of the first and second components in an ejected compound, the ejection device comprising an ejection mechanism (12); and a receptacle (16) for receiving the cartridge (26) and having a head plate (17) for limiting the receptacle (16) on a front, in an ejection direction, side thereof, a stop plate (18) for limiting the receptacle (16) on a rear side thereof opposite the front side, first (21) and second (22) stops provided, respectively, at the head plate (17) and the stop plate (18) for holding a cartridge (26) in the receptacle a first position for ejecting a compound having a first ratio, and at least one additional stop (23) for holding the cartridge (26) in the receptacle a second position between the first stop (21) and the at least one additional stop (23) for ejecting a compound having a second ratio, wherein the ejection device comprises side walls (19, 20) extending between the head plate (17) and the stop plate (18) for limiting the receptacle (16) laterally, and the at least one additional stop (23) is provided at one of the side walls (20), and wherein the at least one additional stop (23) is displaceable along the one of the side walls (20).

5. An ejection device according to claim 4, wherein the at least one additional stop (23) comprises a spring element.

6. An ejection device according to claim 4, wherein the at least one additional stop (23) is removably arranged at the receptacle (16).

* * * * *